United States Patent [19]

Oliver et al.

[11] 4,446,980

[45] May 8, 1984

[54] BOTTLE CORK EXTRACTOR

[75] Inventors: Robert Oliver; Richard Branscombe, both of Modesto, Calif.

[73] Assignee: E & J Gallo Winery, Modesto, Calif.

[21] Appl. No.: 378,943

[22] Filed: May 17, 1982

[51] Int. Cl.[3] ..... B65D 41/04

[52] U.S. Cl. ..... 215/276; 215/329

[58] Field of Search ..... 215/276, 296, 329

[56] References Cited

U.S. PATENT DOCUMENTS 3,499,568 3/1970 Vinas Riera ..... 215/276

FOREIGN PATENT DOCUMENTS 15015 of 1885 United Kingdom ..... 215/276

*Primary Examiner*—Donald F. Norton

*Attorney, Agent, or Firm*—Townsend and Townsend

[57] ABSTRACT

A bottle closure for a beverage bottle is disclosed. A threaded bottle neck receives a hollow extractor having threads complementary to those of the bottle neck. The extractor is engaged with the bottle neck. The extractor has a crown portion including an aperture that is coaxial with a bottle opening; it also has an annular protuberance that is coaxial with the bottle opening. A bottle cork may be inserted through the extractor and into the bottle neck to seal the bottle. An upper portion of the cork is grasped by the annular protuberance such that the extractor grips the cork more firmly then the bottle does. Disengaging the extractor from the bottle neck withdraws the cork from within the bottle; engaging the extractor with the bottle neck advances the cork into the bottle to thereby seal it.

2 Claims, 6 Drawing Figures

BOTTLE CORK EXTRACTOR

BACKGROUND OF THE INVENTION

1. Field of the Invention

The present invention relates to devices for sealing bottles, and more particularly, to a cork extractor wherein a bottle may be sealed, opened, and resealed.

2. Description of the Prior Art

Fine wines are sold in bottles sealed with a natural cork. Some people insist that the value of using a natural cork when sealing a wine bottle is purely aesthetic. However, it is generally accepted that sealing a wine bottle with a natural cork improves the flavor of the wine.

A problem with wine bottles that are sealed with natural corks is that they cannot be opened without a corkscrew or other such wine bottle cork remover. This is a definite drawback because the beverage industry as a whole has gone to containers that are readily opened without the use of corkscrews or bottle openers. For example, beer bottles have twist-off metal caps, soft drinks have pop-top cans, and less expensive wines have screw-on metal caps.

As the average wine drinker's pallet becomes more sophisticated, his demand for a fine wine will certainly increase. To this end, a wine bottle using a natural cork and having a build-in cork extractor would be an important convenience.

SUMMARY OF THE INVENTION

The present invention provides a wine bottle that is sealed by a cork having a built-in extractor. The bottle neck has a threaded outer surface. A hollow extractor cap has an inner surface along which run threads that are complementary to those of the bottle neck. The extractor may be threaded onto or off of the bottle neck. The extractor cap has a crown portion that includes an aperture. When the cap is threaded onto the bottle neck the aperture is coaxial with the bottle opening. An annular ring protrudes within the aperture and is coaxial with the aperture. A compressed bottle cork may be inserted through the extractor cap and into the bottle to seal the bottle. The annular ring grasps an upper portion of the cork such that when the extractor is unthreaded from the bottle neck the cork is withdrawn from within the neck. Conversely, when the extractor is threaded onto the bottle neck the cork is advanced into the bottle neck to seal the bottle.

BRIEF DESCRIPTION OF THE DRAWINGS

The invention is best understood by referring to the specification and the following drawings, in which.

DETAILED DESCRIPTION OF A PREFERRED EMBODIMENT

Figure 1:
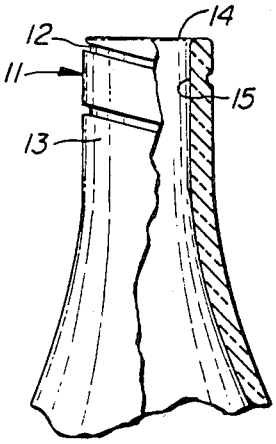
FIG. 1 is a partial cross-section side view of a bottle neck according to the present invention.
Figure 2:
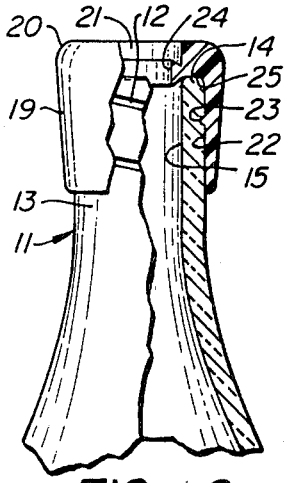
FIG. 2 is a partial cross-sectional side view of a bottle neck showing an extractor cap fitted to the neck.
Figure 4:
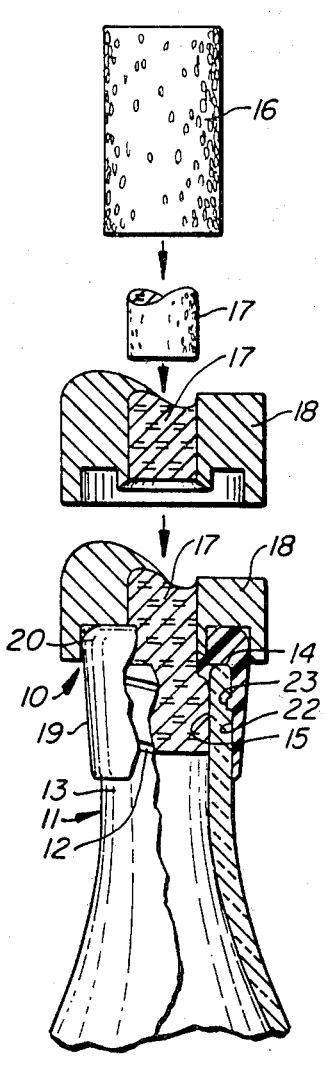
FIG. 4 is a partial cross-sectional side view and pictorial representation of the process by which a bottle cork is inserted through the extractor cap and into the bottle.
Figure 5:
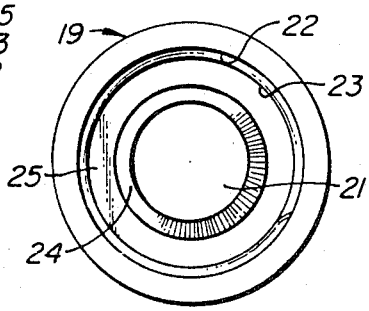
FIG. 5 is a bottom view of an extractor cap.
Figure 6:
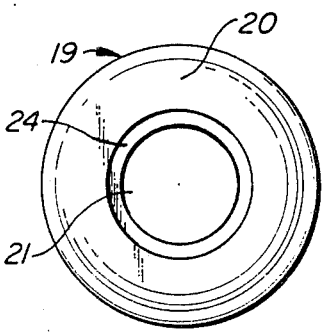
FIG. 6 is a top view of an extractor cap.

The present invention is a bottle cork extractor 10 consisting of a threaded bottle neck 11 (FIG. 1), an extractor cap 19 (FIGS. 5 and 6), and a compressed cork 17 (FIG. 4). The bottle may be of the type that holds wines or other beverages; the bottle shape may be any such shape that is convenient or distinctive.

The bottle should taper to a neck 11 consisting of a finish surface 13 having a spiral thread 12. The bottle neck should have an opening or lip portion 14 that extends along an inner surface 15 and that allows communication between the bottle interior and exterior when the bottle is not sealed so that the bottle's contents may be poured therefrom.

A standard cork 16 is compressed to form a compressed cork 17 used to seal the bottle.

The hollow extractor 19 may be made of plastic or other such material. The extractor includes an inner surface 22 having a diameter equal to that of the bottle's outer neck diameter. The extractor inner surface 22 includes a spiral thread 23 that is complementary to the bottle neck thread 12. The threads may be helical, intermittent, or any other such thread arrangements. Additionally, the threads may be placed at a sharp angle such that the extractor may be mated to the neck with one short twist and may be disengaged therefrom with another short twist. Typically, the threads run such that the extractor is engaged with the neck with a clockwise twist and is disengaged from the neck with a counter-clockwise twist.

The extractor 19 has a crown portion 20. There is an aperture 21 through the crown portion. The aperture is coaxial with the bottle neck opening when the extractor is mounted to the bottle neck and is of the same diameter as the bottle neck's inner diameter. An annular protuberance 24 protrudes within the aperture. A shoulder 25 is provided such that the extractor abuts the bottle neck lip 14 when it is engaged with the bottle neck.

In production, the extractor 19 is engaged with the bottle neck 13 by a capping machine (not shown). The bottle is then shuttled to a corking machine (not shown). The cork machine has a pilot portion 18 (FIG. 4) that engages with the extractor to guide the compressed cork into the bottle.

A standard cork 16 is compressed prior to insertion into the bottle such that a compressed cork 17 is inserted through the cork machine pilot, through the extractor 19, and into and along the bottle neck inner surface 15.

Figure 3:
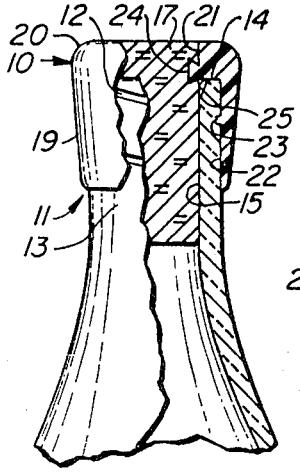
FIG. 3 is a partial cross-sectional side view of a bottle neck showing an extractor cap fitted to the neck and a cork inserted into the neck of the bottle.

Once the cork is inserted into the bottle, the cork machine pilot 17 is removed and the bottle is shuttled to its next station. The cork is inserted as is shown in FIG. 4. Referring to FIG. 3 it can be seen that the cork seals the bottle by compressive engagement with the bottle neck's inner surface 15.

An upper end of the cork is engaged within the extractor aperture. The annular protuberance 24 is of a lesser diameter than that of the bottle neck and thus the cork is more compressed at the annular protuberance than along the bottle neck inner surface. In this way the extractor cap grips the cork more tightly than the bottle neck does. Thus, the cork more readily yields to movement of the extractor than to compression within the bottle neck.

In operation, the extractor is twisted counter-clockwise to unthread it from the bottle neck. In some embodiments of the invention the extractor can be twisted clockwise to disengage it from the bottle neck. As the extractor is disengaged from the neck the bottle cork 17 is pulled upwardly by the annular protuberance 24 of the extractor. When the extractor is totally disengaged from the neck, the cork is substantially removed from the inner surface of the neck.

To reseal the bottle, the cork is placed over the bottle lip 14 and the extractor is twisted clockwise to engage the extractor threads with the bottle neck threads. In some embodiments of the invention the extractor can be twisted counter-clockwise to engage it with the bottle neck. As the extractor engages with the neck and moves downwardly along the neck, the cork is forced to advance within the neck thus sealing the bottle.

The foregoing was given by way of example. It will be obvious to those skilled in the art that the present invention suggests certain variations and various embodiments. Therefore, the scope of the invention should be limited only by the breath of the following claims.

What is claimed is:

1. A resealable bottle, including a tubular bottle neck having a cylindrical opening and having an inner surface and an outer finish surface extending from a lip, comprising:

helical threads extending from said lip along said outer finish surface;

a hollow extractor cap having a helically threaded cylindrical inner surface extending from a cap base to an annular protuberance within said cap, said annular protuberance having a diameter less than that of said bottle's opening, said cap having an apertured crown, said aperture having a diameter equal to that of said bottle's opening and being coaxial with said annular protuberance, the inner diameter of said cap being substantially equal to the outer diameter of said bottle neck, said cap threads being complementary to said outer finish surface threads wherein said cap is engagable with said neck such that said bottle opening, said annular protuberance, and said crown aperture are coaxial, and wherein said cap is disengageable from said neck; and a compressed cork bottle stopper having a diameter greater than that of said bottle opening such that said stopper, when inserted through said bottle opening and advanced along said bottle inner surface into said bottle, seals said bottle; and wherein said cork is compressively gripped by said annular protuberance such that said cork is advanced into said bottle neck when said extractor cap is engaged with said bottle neck and such that said cork is withdrawn from said bottle neck when said extractor cap is disengaged from said bottle neck.

2. The bottle of claim 1, said hollow extractor cap further comprising:

a stopper pilot for compressing and guiding an uncompressed cork bottle stopper into said extractor cap, said pilot having a flared aperture formed therethrough initially having an inner diameter substantially the same as that of said uncompressed cork bottle stopper, said aperture sloping inwardly to provide an inner diameter substantially the same as that of said annular protuberance, said pilot being adapted to engage with said extractor cap crown such that said uncompressed cork bottle stopper is compressed to be readily guided past said annular protuberance by said stopper pilot when said stopper is initially inserted partially through said cap and into said bottle.

* * * * *